US009630042B2

(12) United States Patent
Kucharski

(10) Patent No.: US 9,630,042 B2
(45) Date of Patent: Apr. 25, 2017

(54) METHOD AND APPARATUS FOR EXTREMITY REHABILITATION

(71) Applicant: Jason J. Kucharski, Cleveland, OH (US)

(72) Inventor: Jason J. Kucharski, Cleveland, OH (US)

( * ) Notice: Subject to any disclaimer, the term of this patent is extended or adjusted under 35 U.S.C. 154(b) by 299 days.

(21) Appl. No.: 13/854,472

(22) Filed: Apr. 1, 2013

(65) Prior Publication Data

US 2014/0296044 A1 Oct. 2, 2014

(51) Int. Cl.
*A63B 21/00* (2006.01)
*A63B 71/00* (2006.01)
(Continued)

(52) U.S. Cl.
CPC ..... *A63B 21/00185* (2013.01); *A61H 1/024* (2013.01); *A61H 1/0244* (2013.01);
(Continued)

(58) Field of Classification Search
CPC ..... A63B 2022/0079; A63B 21/00185; A63B 21/1469; A63B 21/154; A63B 22/201; A63B 22/203; A63B 21/00178; A63B 21/00181; A63B 21/155; A63B 21/156; A63B 21/1609; A63B 21/4031; A63B 21/4043; A63B 2022/0094; A63B 22/0087; A63B 2023/006; A63B 23/035; A63B 21/151; A63B 21/4027; A63B 22/20; A63B 22/0076; A63B 22/0079; A63B 23/0494; A63B 23/0355; A63B 71/0009; A63B 71/0018; A63B 2208/0228; A63B 2208/0233; A63B 2208/0238; A61H 1/005; A61H 1/020237; A61H 1/024; A61H 1/0244; A61H 1/0255;A61H 1/0259; A61H 2001/0248; A61H 2001/0251; A61H 2201/1276; A61H 2201/1269; A61H 2201/1635; A61H 2201/164; A61H 2201/1664; A61H 2201/1633; A61H 2201/0149; A61H 2201/12; A61H 1/0218; A61H 1/0237; A61H 1/00; A61H 2201/1261; A61H 2201/1284; A61H 2201/1657; A61H 2201/1669; A61H 2203/0425; A61H 2203/0431; A61H 2203/0437; A61H 1/02; A61H 1/0251; A61H 2201/1253; A61H 2201/0431; A61H 2205/102; A61F 5/04; A61F 5/042
(Continued)

(56) References Cited

U.S. PATENT DOCUMENTS 339,638 A * 4/1886 Goldie ..... 482/96
1,577,809 A * 3/1926 Randall ..... 482/72
(Continued)

OTHER PUBLICATIONS

"Post Surgery Rehabilitation Program: Medial Patellofemoral Ligament Reconstruction and Imbrication." Banff Sport Medicine. Aug. 2011. Accessed Mar. 21, 2016.*

*Primary Examiner* — Joshua Lee
(74) *Attorney, Agent, or Firm* — Renner, Kenner, Greive, Bobak, Taylor & Weber Co., LPA

(57) ABSTRACT

A lower extremity mobilizer for use in rehabilitation is provided. A seat is slidably maintained upon a base, with a foot support brace being provided at an end of the base to receive the foot of a leg provided for arthrokinematic treatment. A cord and pulley system is provided between the seat and the end of the base. In use, a patient is seated with a foot received by the foot support brace. The patient provides arthrokinematic motion to his leg by pulling himself and the seat toward the end of the device having the foot
(Continued)

support brace. The procedure is undertaken in a closed chain motion, with the foot constantly engaging the foot support brace, and is done so as a rate, timing and extent under the control of the patient.

8 Claims, 6 Drawing Sheets

(51) Int. Cl.
*A63B 26/00* (2006.01)
*A61H 1/00* (2006.01)
*A61H 1/02* (2006.01)
*A61H 5/00* (2006.01)

(52) U.S. Cl.
CPC ..... *A61H 2201/1269* (2013.01); *A61H 2201/1276* (2013.01); *A61H 2201/164* (2013.01); *A61H 2201/1633* (2013.01); *A61H 2201/1635* (2013.01); *A61H 2201/1664* (2013.01); *A61H 2203/0437* (2013.01)

(58) Field of Classification Search
USPC ..... 482/66, 68, 72–73, 92–96, 99–103, 114,482/125, 131–139, 142, 145, 122–123; 601/23, 601/33–35, 52, 98–99, 115–116, 24, 84, 97
See application file for complete search history.

(56) References Cited

U.S. PATENT DOCUMENTS 1,750,549 A * 3/1930 Thomson et al. ..... 482/72
1,866,868 A * 7/1932 Thomson et al. ..... 482/72
1,982,843 A * 12/1934 Traver ..... A63B 22/001 482/70
1,994,593 A * 3/1935 Schmidt ..... 482/72
3,164,150 A * 1/1965 Reid ..... 601/97
3,261,606 A * 7/1966 Petros et al. ..... 482/72
3,658,327 A * 4/1972 Thiede ..... 482/96
3,892,404 A * 7/1975 Martucci ..... 482/96
4,004,801 A * 1/1977 Campanaro et al. ..... 482/96
4,101,124 A * 7/1978 Mahnke ..... 482/96
4,468,025 A * 8/1984 Sferle ..... A63B 21/068 482/133
4,512,571 A * 4/1985 Hermelin ..... 482/70
D284,597 S * 7/1986 Smith ..... 482/134
4,706,953 A * 11/1987 Graham ..... A63B 21/0622 482/110
4,798,378 A * 1/1989 Jones ..... 482/72
4,884,800 A * 12/1989 Duke ..... 482/73
4,911,438 A * 3/1990 Van Straaten ..... 482/96
5,029,848 A * 7/1991 Sleamaker ..... A63B 21/068 482/55
5,066,005 A * 11/1991 Luecke ..... 482/96
5,072,929 A * 12/1991 Peterson et al. ..... 482/72
5,110,118 A * 5/1992 Winey ..... 482/73
5,354,251 A * 10/1994 Sleamaker ..... A63B 21/156 482/142
5,470,295 A * 11/1995 Wang ..... 482/71
5,728,034 A * 3/1998 Lamothe ..... 482/131
5,759,137 A * 6/1998 Huang ..... A63B 21/00181 482/142
5,792,079 A * 8/1998 Hatfield ..... A61H 23/00 482/114
6,238,322 B1 * 5/2001 Hsu ..... A63B 21/068 482/123
6,692,412 B2 * 2/2004 Chen et al. ..... 482/96
7,060,003 B1 * 6/2006 Reynolds ..... A63B 7/04 273/451
7,597,656 B2 * 10/2009 Trees ..... A61H 1/0229 482/142
7,766,801 B2 * 8/2010 Campanaro et al. ..... 482/96
7,857,736 B2 * 12/2010 Merrithew et al. ..... 482/121
8,235,874 B2 * 8/2012 D'Eredita ..... 482/72
8,663,074 B2 * 3/2014 Uygan ..... 482/95
8,721,506 B2 * 5/2014 Gerschefske ..... 482/96
8,808,152 B1 * 8/2014 Midgett ..... A63B 21/015 482/146
D726,263 S * 4/2015 Anderson ..... D21/676
2008/0015095 A1 * 1/2008 Savsek ..... A63B 21/0455 482/121
2011/0009249 A1 * 1/2011 Campanaro et al. ..... 482/131
2011/0143898 A1 * 6/2011 Trees ..... A61G 7/005 482/142
2011/0207585 A1 * 8/2011 Burns ..... A61F 5/0123 482/124
2012/0100965 A1 * 4/2012 Dreissigacker .... A63B 21/0088 482/72
2014/0141948 A1 * 5/2014 Aronson ..... A63B 21/023 482/128

* cited by examiner

METHOD AND APPARATUS FOR EXTREMITY REHABILITATION

TECHNICAL FIELD

The invention herein resides in the art of therapeutic devices and, more particularly, to an orthosis machine and its method of use. Particularly, the invention relates to a method and apparatus for assisting in the rehabilitation of lower extremity joints following surgery such as knee and hip replacement, ankle surgery, and the like. Specifically, the invention provides a method and apparatus that seeks to mimic the natural knee, hip, and ankle flexion in non-weight bearing use.

BACKGROUND OF THE INVENTION

The joints of lower extremities are often in need of repair through surgical procedures. Quite common among these are hip and knee replacements, although surgery on the ankle is also quite common. Following such surgeries, there is necessarily a period of therapy and rehabilitation, where the repaired joint is mobilized or flexed during the healing process in order to ensure that the joint has recovered properly and provides the patient or individual with as close to a full range of mobility as possible.

In the past, patients would typically engage therapy sessions, during which a therapist would mobilize and manipulate the affected joint while the patient remained otherwise immobile. There is, of course, pain associated with such mobilization and manipulation, and patients are often apprehensive of such treatment and urge against the mobilization efforts of the therapist during treatment. To a large extent, the treatment is out of the control of the patient, giving rise to the apprehension and repelling patient reaction.

Previous devices for lower extremity therapy through mobilization have typically functioned in an open chain manner, creating a sliding motion of the tibia around the femur. This is contrary to the natural flexion of the knee, and the same is generally true with the hip and ankle. Such machines and their use are counterproductive to effective therapy and rehabilitation.

DISCLOSURE OF INVENTION

In light of the foregoing, there is a need in the art for a rehabilitation device and its method of use for lower extremity mobilization that seeks to replicate natural knee, hip and ankle flexion during use.

There is further a need in the art for a rehabilitation device and method of use for lower extremity mobilization that is patient driven, eliminating the apprehension of the patient typically encountered during therapy, thereby maximizing the benefits to the patient.

Indeed, there is a need in the art, for a rehabilitation device and its method of use for lower extremity mobilization that mimics natural knee, hip and ankle flexion in non-weight bearing operation.

The present invention seeks to achieve the foregoing needs by recreating the natural lower extremity mechanics through a closed chain motion. Such a closed chain motion of the lower extremity is the transferring of the body around, for example, a fixed foot (similar to squatting) while in a seated position. The arthrokinematics (joint motion) of the knee, for example, is naturally a rolling motion and not a sliding motion. While the previous orthosis machines have functioned in an open chain position and create a sliding motion of the tibia around the femur, the instant invention, presented below, mimics the natural knee, hip and ankle flexion of the body because the only fixed point in implementation of the present invention is the foot, allowing the femur and tibia to roll on each other, mimicking, for example, natural knee flexion and reducing the friction of the unnatural sliding mechanism of the knee.

Another unique aspect of the invention is that it contemplates patient control. As will be seen below, the patient provides the force by selectively pulling on a drive mechanism, eliminating apprehension from the user, since the user or patient controls the amount of force being applied. Patient apprehension about flexing a knee or other repaired joint following surgery has long been a limiting factor in rehabilitation of post-surgical patients. Once the user has direct control of the amount of force flexing the knee, apprehensions are significantly reduced and increased mobility is achieved.

The foregoing and other benefits of the invention are achieved by a lower extremity mobilizer, comprising: a base maintained in an elevated position by support members; a seat slidably maintained upon said base; a foot support brace maintained at a first end of said base; and a patient regulated mobilization system interposed between said seat and said first end of said base and accommodating movement of said seat upon said base between a second end and said first end of said base.

Other benefits of the invention are achieved by a method of rehabilitating lower extremities of a patient's body, comprising: seating a patient upon a seat; engaging a first foot of the patient with a first foot support; and allowing the patient to draw the seat from a starting position toward the first foot support at a rate and to a degree determined by the patent, while the patient is seated and the patient's first foot is engaged with the first foot support, recreating natural lower extremity mechanics through closed chain motion.

DESCRIPTION OF DRAWINGS

For a complete understanding of the various benefits, structure and methods of the invention, reference should be made to the following detailed description and accompanying drawings wherein.

DETAILED DESCRIPTION OF PREFERRED EMBODIMENT

Figure 1:
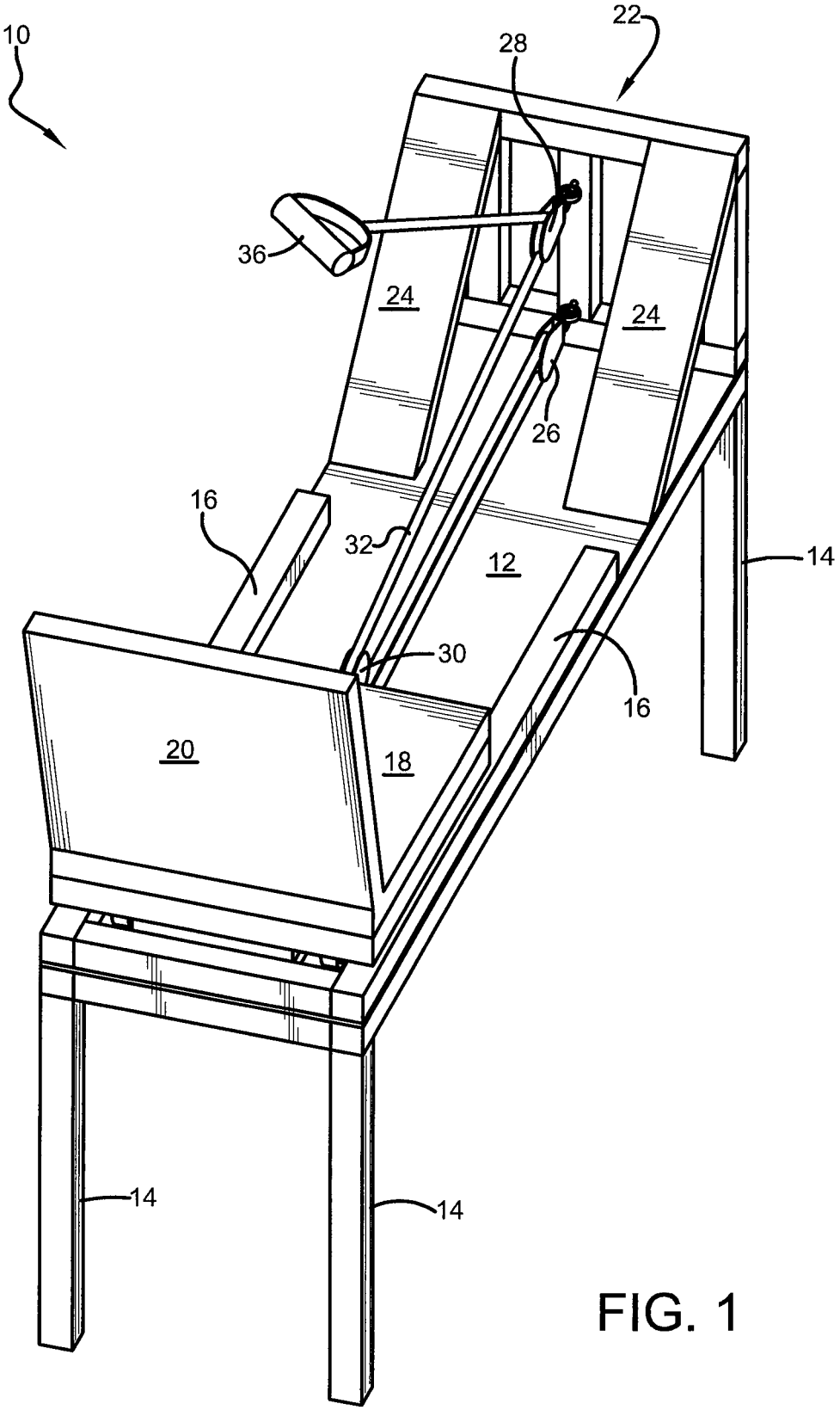
FIG. 1 is a perspective view of the rehabilitation device of the invention taken from the seat end of the device.
Figure 2:
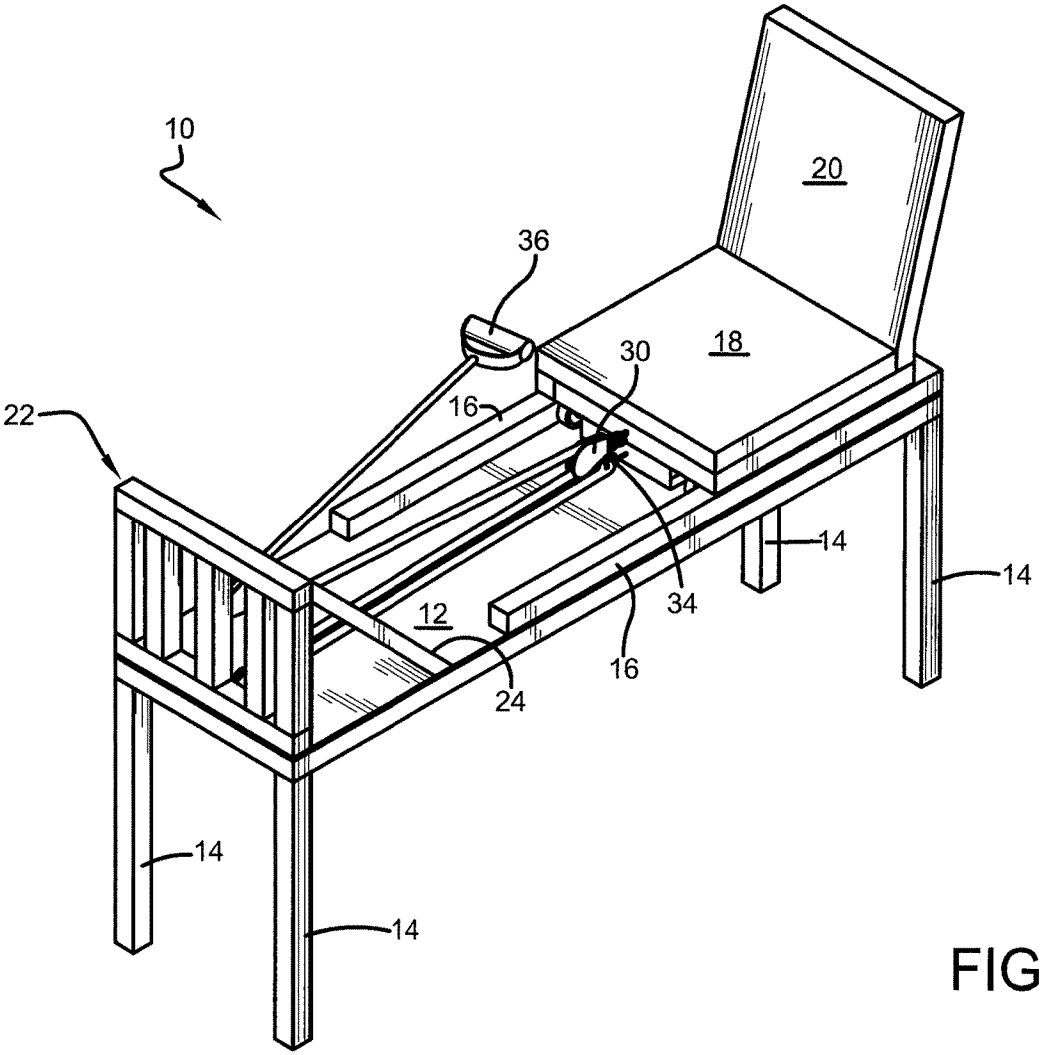
FIG. 2 is a perspective view of the rehabilitation device of the invention taken from the foot end of the device.

Referring now to the drawings and more particularly FIGS. 1 and 2, it can be seen that a rehabilitation device in the form of a lower extremity mobilizer made in accordance with the invention is designated generally by the numeral 10.

The rehabilitation device 10 preferably includes a base 12 and support members such as legs 14 at opposite ends or corners to maintain the seat 12 elevated above a floor by a distance on the order of 16"-20". Side rails 16 are fixed to and extend along opposite edges of the base 12 for receiving and confining a seat 18 therebetween. The seat 18 is preferably provided with a seat back 20, extending at a slight angle rearwardly for patient comfort. An end piece or bracket 22 is secured to an end of the base 12. A pair of foot support braces 24 are appropriately interconnected between the base 12 and the end bracket 22, as shown. The foot support braces 24 are typically angled with respect to the base 12 by an angle on the order of 35°-55°, and preferably 45°. The invention contemplates that the foot support braces 24 may be adjustable, allowing the angle to be selected by the patient or therapist. Any of various methods of adjustability can be employed, such as the use of retractable pins and mating holes between the foot support braces 24, base 12 and end bracket 22, respectively.

Pulley wheels 26, 28 are secured to the end bracket 22, as shown. In similar fashion, a pulley wheel 30 is secured to a front edge of the seat 18, as shown. A cord or rope 32 is strung through the pulley wheels 26, 28, 30, with a first end of the cord or rope 32 being secured to an eyelet 34 on the front edge of the seat 18. According to an embodiment of the invention, the cord or rope 32 passes from the eyelet 34, through the pulley wheel 26, thence through the pulley wheel 30, and finally through the pulley wheel 28, with the opposite end of the cord or rope 32 optionally having a handle 36 or other type of hand securing device present thereon. It will be appreciated that the number of pulley wheels and the mechanical advantage desired may vary.

Figure 3:
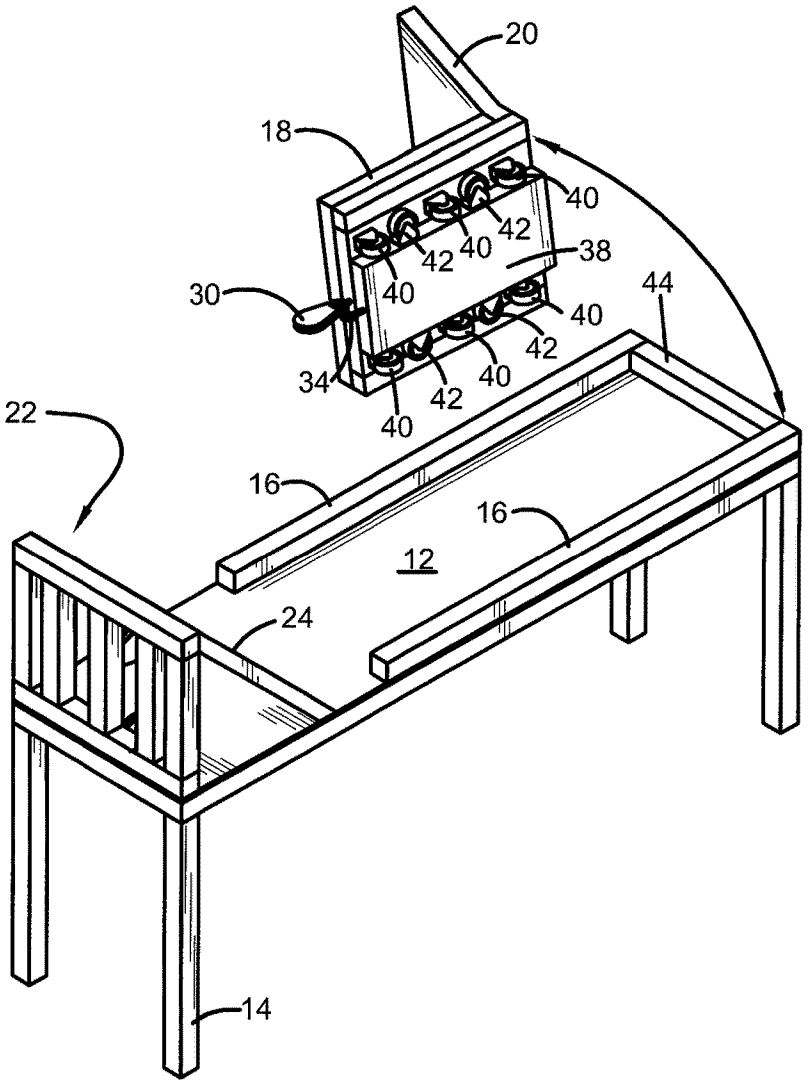
FIG. 3 is an illustrative perspective view of the rehabilitation device of the invention showing the underside of the seat.

With reference now to FIG. 3, it can be appreciated that the seat 18 has a plate 38 secured to the bottom thereof. A plurality of vertically oriented casters 40 are secured to the bottom of the seat 18 along the side of the plate 38, as shown. Similarly, a plurality of horizontally oriented casters 42 are secured to the plate 38 along the edge thereof. Desirably, the casters 40, 42 alternate with respect of each other. When the seat 18 is placed upon the base 12, it will be appreciated that the vertically oriented casters 40 are adapted to roll upon the top of the base 12, while the horizontally oriented casters 42 are provided to engage the sides of the rails 16. It will be appreciated, however, that other means such as rails, ways, slides and the like may be employed.

Finally, a stop bar 44 extends across a back end of the base 12 between the side rails 16, to prevent the seat 18 from leaving the base 12 rearwardly. The plate 38 and casters 40, 42, in conjunction with the side rails 16 and stop bar 44 confine the operation of the seat within the perimeters so defined.

Figure 4:
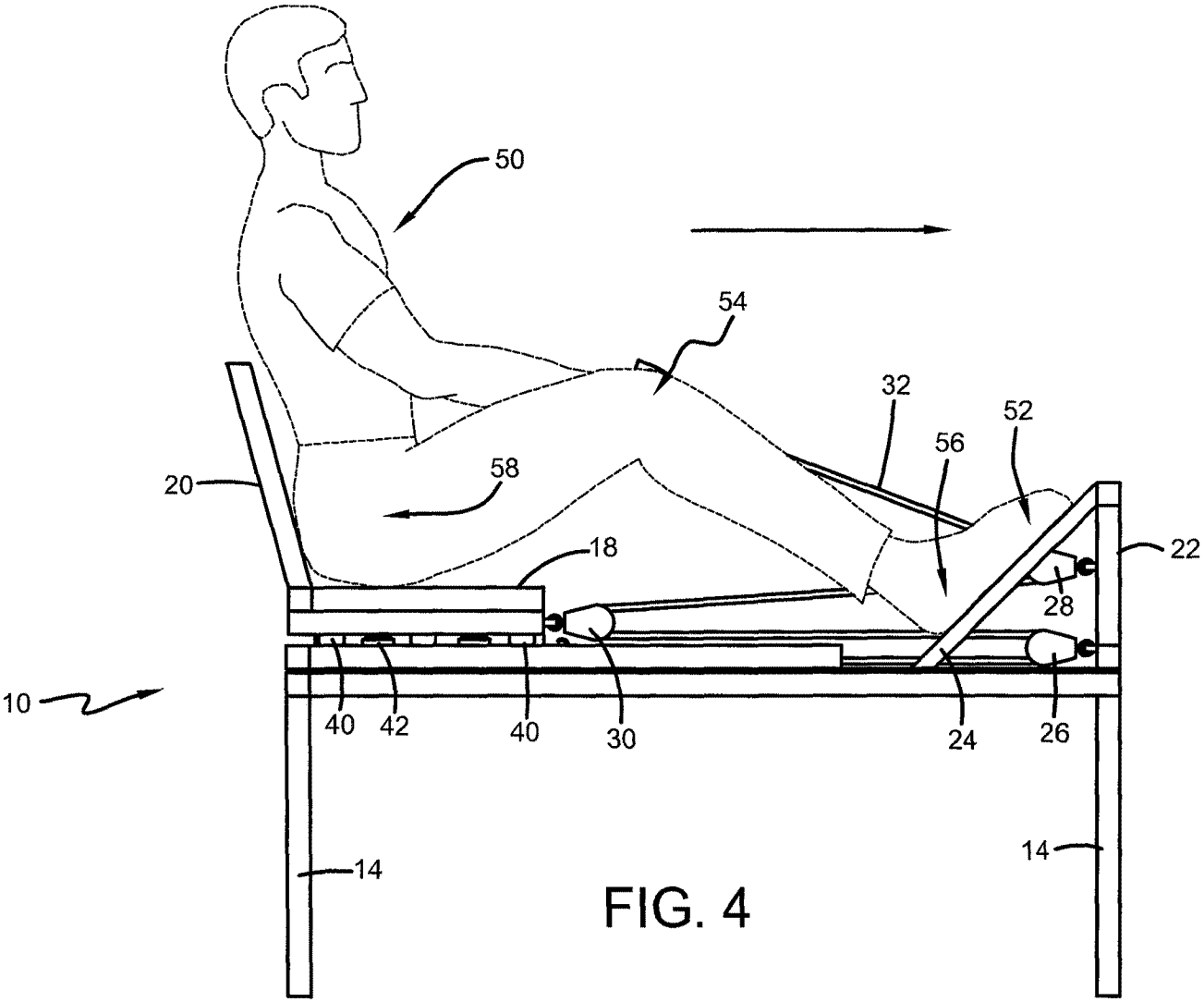
FIG. 4 is a side elevational view of the rehabilitation device of the invention showing its use in a starting position.
Figure 5:
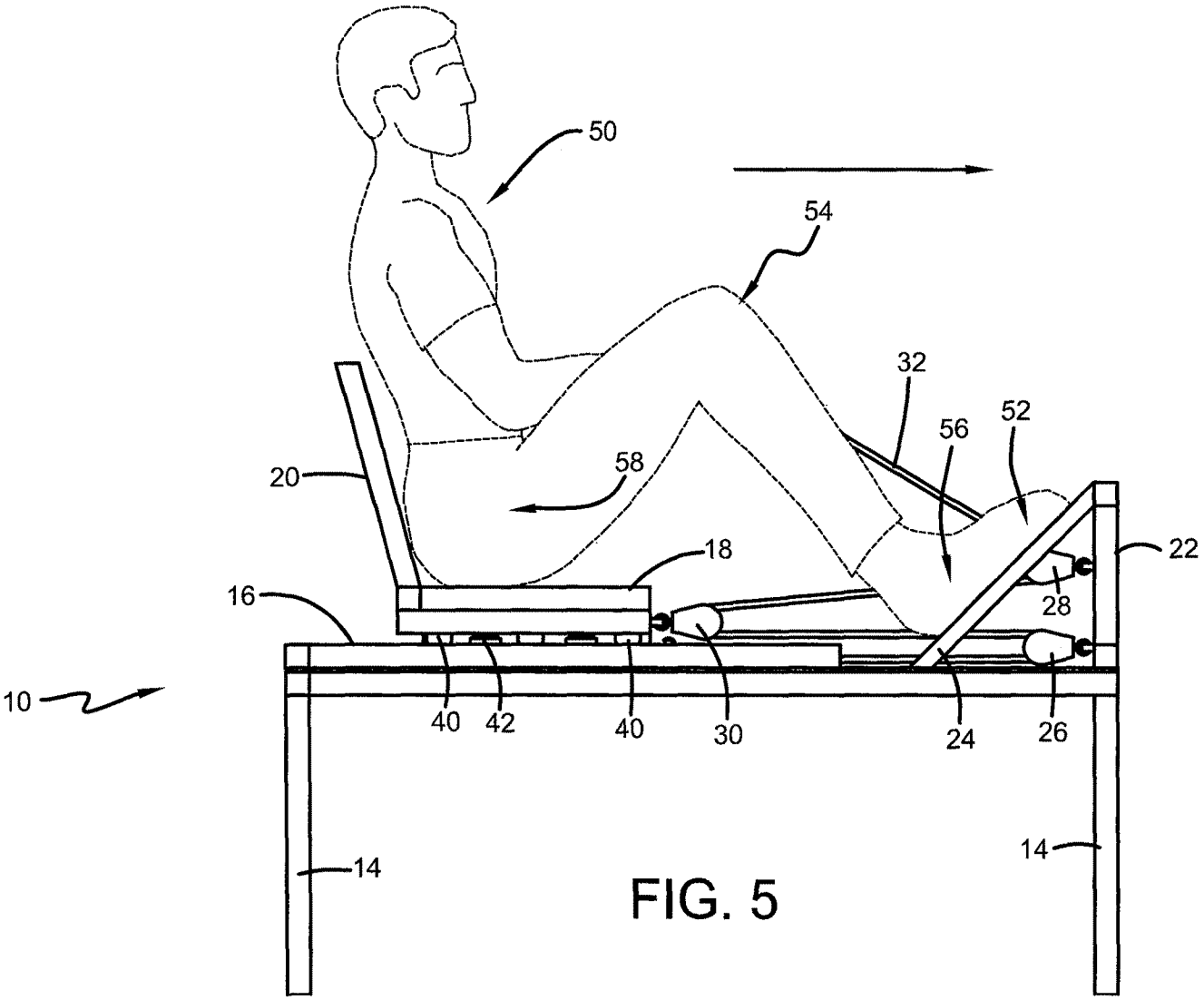
FIG. 5 is a side elevational view of the rehabilitation device of the invention showing its use in an intermediate position.
Figure 6:
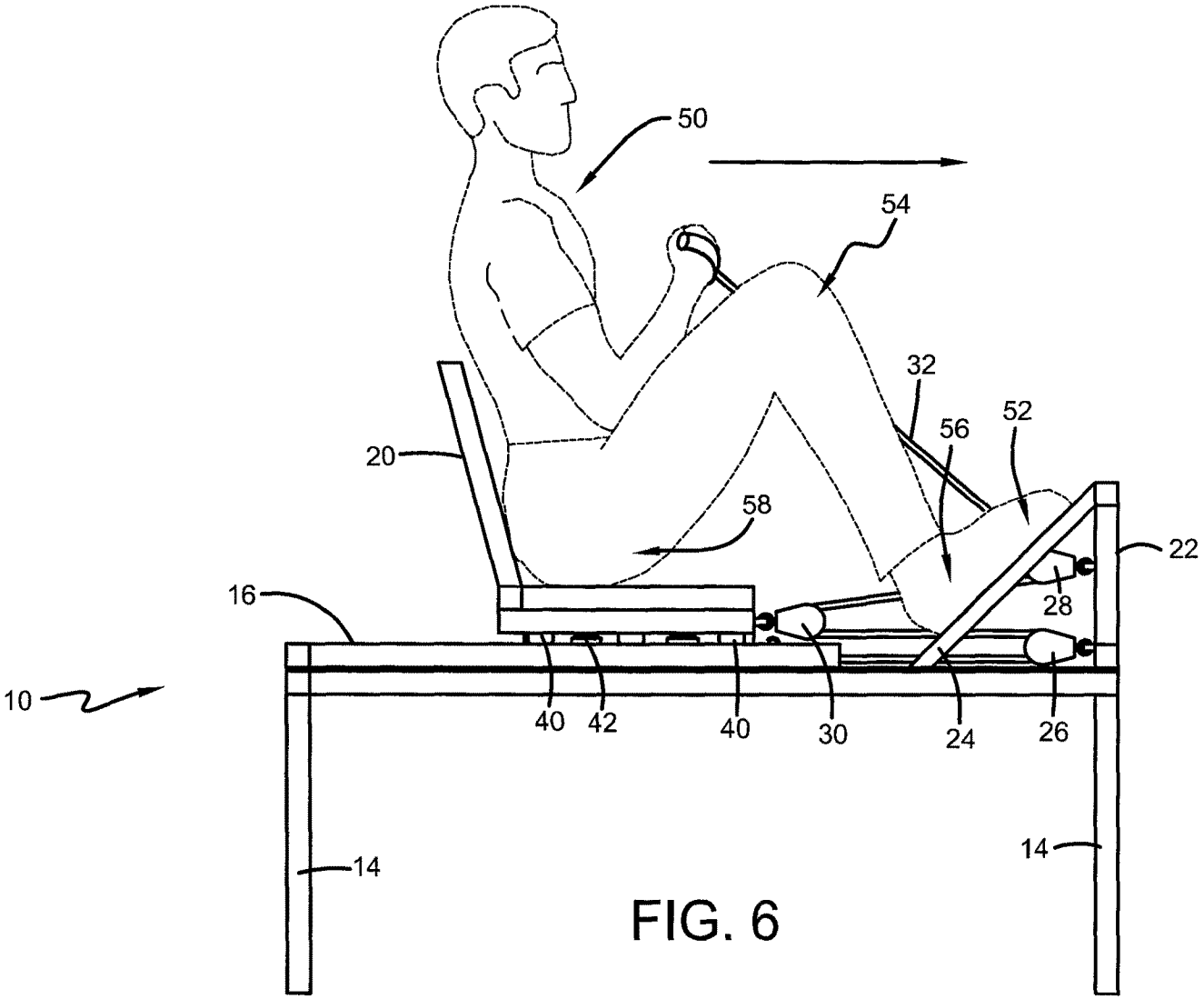
FIG. 6 is a side elevational view of the rehabilitation device of the invention showing the same at an end of a flexure cycle.

With an understanding of the structure of the invention, reference should now be had to FIGS. 4-6, where an appreciation of its utilization may be attained. In a starting position, a patient 50 is seated upon the seat 18 in its rearmost position. The patient's foot 52 is received upon the associated foot support brace 24 with the leg extended with a slight bend, as shown. The joints of the knee 54, ankle 56 and hip 58 are positioned as shown, and it will be appreciated that the foot 52 is maintained upon and against the foot support brace 24 throughout operation such that the therapy is undertaken in a closed chain mode, with the foot always in a support position.

In use, the other leg of the patient may either be placed upon the associated foot support brace 24, or may actually engage the floor.

The patient 50 begins to pull himself forwardly, providing an arthrokinematic motion to the joints of the knee 54 ankle 56 and hip 58 in a closed chain mode. The patient controls the rate at which the movement from FIG. 4 to FIG. 5 is undertaken, and whether it is taken in a single motion or progressively in increments. With the patient being under control of the function of the unit, his/her apprehension is substantially eliminated and the associated pain is reduced.

At FIG. 6, the patient 50 has drawn himself by the cord 32 to the furthermost position in utilization of the device, applying further arthrokinematic motion to the joints of concern. Again, the patient 50 has done this at a rate and over a period of time and using the increments necessary to ensure patient comfort, both mentally and physically.

Upon reaching the position of FIG. 6, the patient may then use his other leg to return to the starting position of FIG. 1. Again, that leg may either push against the floor, or with its associated foot support brace 24. The process may then begin anew, for a desired number of repetitions.

Thus it can be seen that the various benefits of the invention have been achieved by the structure and method presented and described above. While in accordance with the patent statutes only the best mode and preferred embodiment of the invention has been presented and described in detail, the invention is not limited thereto or thereby. Accordingly, for an appreciation of the true scope and breadth of the invention, reference should be made to the following claims.

What is claimed is:

1. A lower extremity mobilizer, comprising:

a base having first and second ends, said base being maintained in a level elevated position by fixed support members at each of said first and second ends;

an unbiased seat freely slidably maintained upon said base;

a foot support brace maintained at said first end of said base; and a patient regulated mobilization system interposed between said seat and said first end of said base and accommodating unbiased movement of said seat upon said base between said second end and said first end of said base, wherein said mobilization system comprises a cord having a first end fixedly connected to said seat and a second free end for engagement by a patient and wherein said mobilization system is configured for passively moving lower extremity joints of a post-surgery patient seated upon said seat with a foot fixedly planted on said foot support brace to effect recovery of a range of motion of the joints.

2. The lower extremity mobilizer according to claim 1, wherein said mobilization system further comprises a pulley system receiving said cord and interposed between said first and second ends thereof.

3. The lower extremity mobilizer according to claim 2, wherein said pulley system comprises said cord being looped through first and third pulleys connected to said first end of said base and a second pulley connected to said seat.

4. The lower extremity mobilizer according to claim 1, wherein said seat has first rollers on a bottom surface thereof in operative engagement with said base.

5. The lower extremity mobilizer according to claim 4, wherein said base has a side rail along at least a portion of each side thereof, and wherein said seat has second rollers on said bottom side thereof in engagement with said side rails.

6. The lower extremity mobilizer according to claim 5, further comprising a stop bar extending across a back end of said base and restricting movement of said seat beyond said stop bar.

7. The lower extremity mobilizer according to claim 2, wherein said foot support brace is maintained at a selected angle with respect to said base.

8. The lower extremity mobilizer according to claim 7, wherein said selected angle is between 35° and 50°.

* * * * *